US005085356A

United States Patent [19]

Waltenspühl

[11] Patent Number: 5,085,356

[45] Date of Patent: Feb. 4, 1992

[54] REFRACTORY SHUTOFF ASSEMBLY AND ROTOR AND STATOR THEREFOR

[75] Inventor: Rolf Waltenspühl, Hünenberg, Switzerland

[73] Assignee: Stopinc Aktiengesellschaft, Baar, Switzerland

[21] Appl. No.: 540,627

[22] Filed: Jun. 19, 1990

[30] Foreign Application Priority Data

Jul. 11, 1989 [CH] Switzerland ..... 02593/89

[51] Int. Cl.[5] ..... B22D 41/08

[52] U.S. Cl. ..... 222/598; 222/597

[58] Field of Search ..... 266/236; 222/597, 598, 222/599, 601, 602; 164/337, 437

[56] References Cited

U.S. PATENT DOCUMENTS 4,728,012 3/1988 Monks ..... 266/236

FOREIGN PATENT DOCUMENTS 3731600 4/1989 Fed. Rep. of Germany .

0264255 11/1988 Japan ..... 164/337

0264256 11/1988 Japan ..... 164/337

*Primary Examiner*—Scott Kastler

*Attorney, Agent, or Firm*—Wenderoth, Lind & Ponack

[57] ABSTRACT

A refractory shutoff assembly for controlling the discharge of molten metal from a metallurgical vessel includes a refractory tubular stator to be mounted in a wall of a metallurgical vessel. The stator has an axial opening, inner and outer surfaces, and at least one transverse opening extending between the inner and outer surfaces. The assembly also includes a refractory rotor including inner and outer tubular sections arranged concentrically relative to each other. At least one of the inner and outer tubular sections has therethrough at least one transverse opening. The rotor is arranged with an outer surface of the inner tubular section sealing with the inner surface of the stator and with an inner surface of the outer tubular section sealing with the outer surface of the stator.

30 Claims, 2 Drawing Sheets

REFRACTORY SHUTOFF ASSEMBLY AND ROTOR AND STATOR THEREFOR

BACKGROUND OF THE INVENTION

The present invention relates to a refractory shutoff assembly or unit for controlling the discharge of molten metal from a metallurgical vessel. Particularly, the present invention relates to such an assembly including a refractory stator and a refractory rotor. The present invention also relates to such refractory stator and such refractory rotor individually. . The stator is adapted to be mounted in the wall of a metallurgical vessel, and the rotor is positioned generally within the interior of the vessel and is guided for movement relative to the stator by the stator. At least one transverse opening and at least one axial opening in the assembly can be brought into and out of alignment by rotating and/or axially moving the rotor relative to the stator, thereby achieving relative opening and closing of the shutoff assembly.

Such a shutoff assembly is suitable particularly for metallurgical vessels employed in continuous casting systems wherein molten metal is poured or discharged from a metallurgical vessel in a controlled manner into a continuous casting mold. The shutoff assembly is controlled in such a manner by means of a control process that the quantity of molten metal discharged from the metallurgical vessel maintains a constant filling height in the mold. Higher requirements for accurately metered pouring or discharge from the metallurgical vessel are imposed on the shutoff assembly that serves as a control element of such discharge.

German DE-OS 37 31 600 discloses a stator mounted in a vessel wall and a rotor guided in the stator within the vessel, wherein the rotor can be rotated and also moved longitudinally or axially by a drive arranged above the vessel. Transverse inlet openings in the walls of the stator or rotor and a longitudinal opening originating from such openings in the stator make it possible to pour or discharge molten metal when such openings overlap. Under normal operating conditions, relatively low torsion, tension or other forces act on the rotor or stator, such elements of course being formed of a refractory ceramic material. However, in the event that some molten metal infiltrates between the stator and rotor and then solidifies, such can cause the rotor to jam with respect to the stator, whereby interruption of discharge of the molten metal is prevented. Also, such jamming can cause parts of the stator or rotor to break, thereby also preventing shutoff of the assembly.

SUMMARY OF THE INVENTION

With the above discussion in mind, it is an object of the present invention to provide an improved refractory shutoff assembly of the stator-rotor type whereby it is possible to overcome the above and other prior art disadvantages.

It is a further object of the present invention to provide such an assembly capable of improved reliability of operation, whereby jamming or breakage of the rotor-stator parts is much less likely.

It is an even further object of the present invention to provide novel rotor and stator structures for use in such shutoff assembly.

The above objects are achieved in accordance with the present invention by the provision that the rotor includes inner and outer tubular members or sections that are arranged concentrically relative to each other.

The stator is a refractory tubular member to be mounted in a wall of the metallurgical vessel. The stator has an axial opening therethrough, inner and outer surfaces, and at least one transverse opening extending between the inner and outer surfaces. At least one of the inner and outer tubular sections of the rotor has therethrough at least one transverse opening. The rotor is arranged with respect to the stator to be within the interior of the metallurgical vessel, and specifically with an outer surface of the inner tubular section sealing with the inner surface of the stator and with an inner surface of the outer tubular section sealing with the outer surface of the stator. The rotor is movable relative to the stator between a closed position, wherein the at least one transverse opening in the at least one tubular section of the rotor is isolated from the at least one transverse opening in the stator, and an open position whereat such transverse openings are in alignment.

As a result of the features of the present invention, if one of the tubular or pipe sections of the rotor should jam and/or break, the other tubular or pipe section that remains unbroken still can function to close off discharge of molten metal. This can be achieved without problem and even can achieve a conditional continuing of discharge. Furthermore, the rotor, that of course is sensitive to bending and torsional forces, is reinforced structurally due to the double-wall or tubular section configuration thereof. Accordingly, the rotor of the present invention is less subject to breakage.

Additionally, upon the occurrence of severe wear, and thus possible leakage, between the actual preferable control element, formed between the stator and the inner tubular section, closure of the shutoff assembly by the other tubular section still is possible.

Preferably the outer tubular section has therethrough at least one transverse opening of a size greater than the transverse opening through the inner tubular section. Thus, the transverse opening in the outer tubular section serves primarily as a safety shutoff mechanism. The transverse opening in the outer tubular section has a size greater than the transverse opening in the stator and the inner tubular section in the direction of movement of the rotor relative to the stator, and such greater size preferably is by a factor of at least three. The transverse openings in the inner and outer tubular section generally are aligned radially and approximately coaxially. However, the transverse opening in the outer tubular section can be offset with respect to the transverse opening in the inner tubular section in the direction of movement of the rotor relative to the stator. As a result, the transverse opening in the outer tubular section is isolated from or closes the transverse opening in the stator before the transverse opening in the inner tubular section is isolated from the transverse opening in the stator. Therefore, any molten metal still in the transverse opening in the stator upon closing of the shutoff assembly will not remain within the transverse opening in the stator, but rather will be discharged through the still open communication between the discharge openings in the stator and the inner tubular section.

The rotor can be moved relative to the stator either from the top of the metallurgical vessel or from below the metallurgical vessel. The rotor can be moved rotatably and/or axially relative to the stator.

BRIEF DESCRIPTION OF THE DRAWINGS

Other objects, features and advantages of the present invention will be apparent from the following detailed description of preferred embodiments thereof, with reference to the accompanying drawings, wherein.

DETAILED DESCRIPTION OF THE INVENTION

Figure 1:
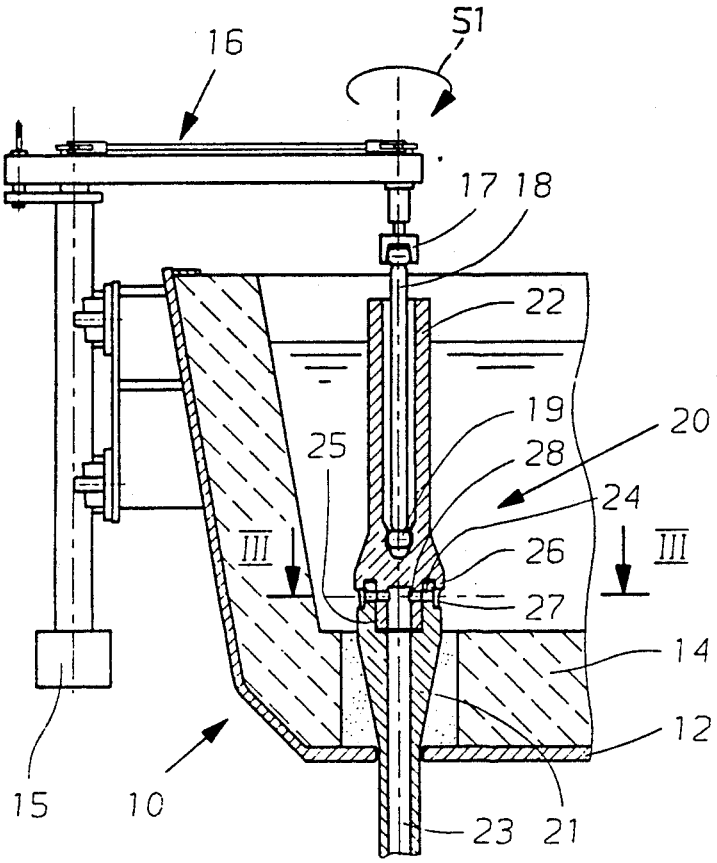
FIG. 1 is a partial longitudinal sectional view of a shutoff assembly in accordance with a first embodiment of the present invention and illustrated as being mounted within a metallurgical vessel.

In FIG. 1 is illustrated somewhat schematically a metallurgical vessel 10 having an interior containing molten metal and including an outer steel jacket 12 and a refractory lining 14. Extending through refractory lining 14 is a nozzle brick within which is mounted a refractory tubular stator 21 of a shutoff assembly 20 in accordance with a first embodiment of the present invention.

The tubular stator 21 has an axial opening 23 therethrough, and at an upper end there are provided inner and outer surfaces with at least one transverse opening 24 extending therebetween. In the illustrated arrangement there are two diametrically aligned openings 24.

Assembly 20 further includes a refractory rotor 22 including integral inner and outer tubular sections 25, 26 arranged concentrically relative to each other. At least one of the inner and outer tubular sections 25, 26 has therethrough at least one transverse opening. In the illustrated arrangement, inner tubular section 25 has therethrough two diametrically aligned transverse openings 28. Similarly, outer tubular section 26 has therethrough two diametrically aligned transverse openings 27. Particularly, openings 27 are in the form of downwardly directed recesses formed in the lower or free end of outer tubular section 26.

The rotor 22 is mounted with respect to the stator 21 such that the inner and outer tubular sections 25, 26 embrace the upper or free end of the stator 21. Particularly, an outer surface of inner tubular section 25 seals with the inner surface of stator 21, and an inner surface of the outer tubular section 26 seals with the outer surface of the stator. Such sealing can be facilitated by means that would be well understood within the art. The rotor is movable relative to the stator (in a manner to be discussed in more detail below) between a closed position whereat the transverse openings in the rotor are isolated from the transverse openings in the stator, and an open position, whereat the transverse openings in the rotor align, in varying degrees, with the transverse openings in the stator. The degree of such alignment can be altered to regulate the quantity of molten metal discharged from the vessel 10, for example into the mold of a continuous casting apparatus.

Figure 4:
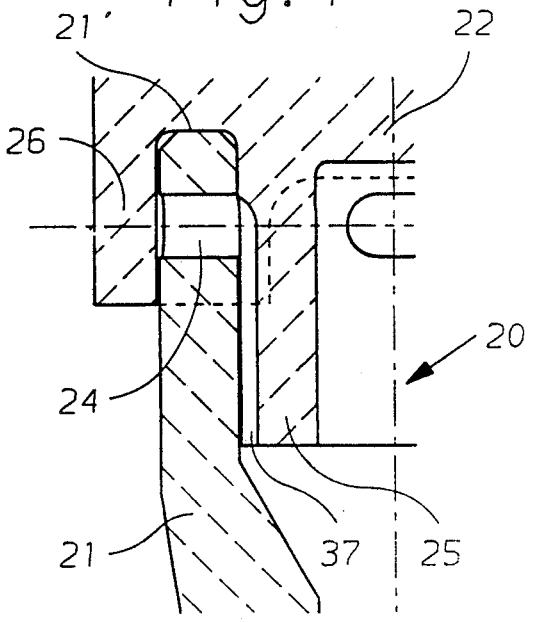
FIGS. 4 and 5 are enlarged partial sectional views illustrating additional embodiments of the assembly of the present invention.

In the arrangement of FIG. 1, the tubular sections of the rotor abut respective stepped surfaces of the stator. This can be envisioned more clearly in FIG. 2. In the embodiment of FIG. 4, the stator has an upper end surface 21' that is abutted by a surface of the rotor that is located between the inner and outer sections.

Figure 2:
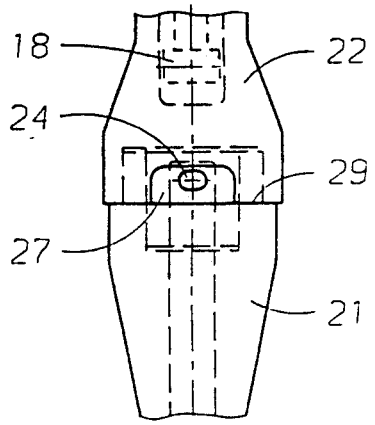
FIG. 2 is a partial side elevation view, on an enlarged scale, of the assembly of FIG. 1.

As shown in FIGS. 1 and 2, rotor 22 is connected to a driving rod 18 in a manner to enable rotation of rod 18 to be transmitted to rotor 22. One skilled in the art readily would understand how to achieve such connection. For example, rod 18 is jointed to a carrier bolt 19 and is driven by a motor 15 via a drive mechanism 16 and a hinge or universal connection 17. Rotation of stator 22 in direction of rotation 51 therefore is achieved.

The quantity of molten metal to be discharged is controlled by openings 28, 24 of inner pipe section 25 and stator 21, respectively. These openings are of the same size. On the other hand, openings 27 of outer tubular or pipe section 26 are of larger size, and particularly are of larger size in the direction of movement of the rotor relative to the stator. Preferably, this greater size is by a factor of at least three. Thus, outer pipe or tubular section 26 basically serves as a pure safety shutoff mechanism functioning to provide reliable closure capability in the event that the inner pipe or tubular section 25 should jam and break off in the stator, or when leaks should develop therebetween. By providing that openings 27 ar at least three times as large as opening 24 of stator 21, it is ensured that the cross section of the passage from the totally open position to the closed position is achieved solely by the openings 24 and 28 and that such change in passage size occurs linearly. This is enabled by the provision of the elongated openings 27. It of course would be possible for all of openings 27, 24, 28 to be the same size. Further, it is possible that the inner tubular section 25 could be provided with the larger sized openings, with the stator and outer tubular section having openings of the same size.

Figure 3:
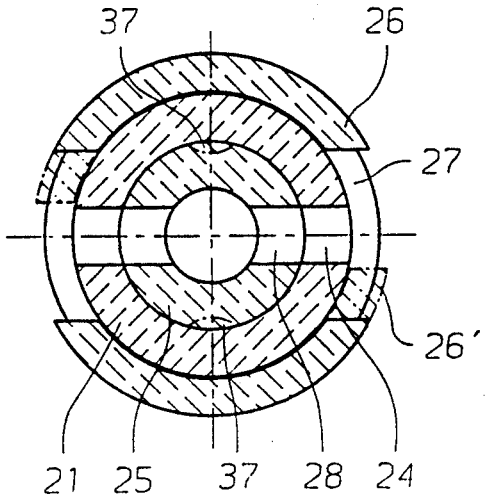
FIG. 3 is an enlarged transverse cross-sectional view taken along line 3—3 in FIG. 1.

Even further however, as illustrated by the phantom lines in FIG. 3, the transverse openings 27 in the outer tubular section 26 can be arranged offset with respect to the transverse openings in the inner tubular section, such offset being in the direction of movement, e.g. rotation, of the rotor relative to the stator. By this arrangement, transverse openings 27 in the outer tubular section are isolated from or close the transverse openings 24 in the stator while there still remains communication between transverse openings in the stator and transverse openings 28 in the inner tubular section. Thus, when the interior of the metallurgical vessel is isolated from the interior of the shutoff assembly, any molten metal still in openings 24 will be allowed to discharge through openings 28 and will not be retained in the assembly to solidify therein.

FIG. 4 illustrates another arrangement to ensure discharge of molten metal from openings 24 in the stator. Thus, when the assembly is in the closed position, axial grooves 37 formed in the outer surface of the inner tubular section 25 will align with the openings 24 in the stator. Thus, grooves 37, also shown in phantom lines in FIG. 3, will allow any metal within openings 24 to be discharged, rather than remain and solidify within openings 24.

Figure 5:
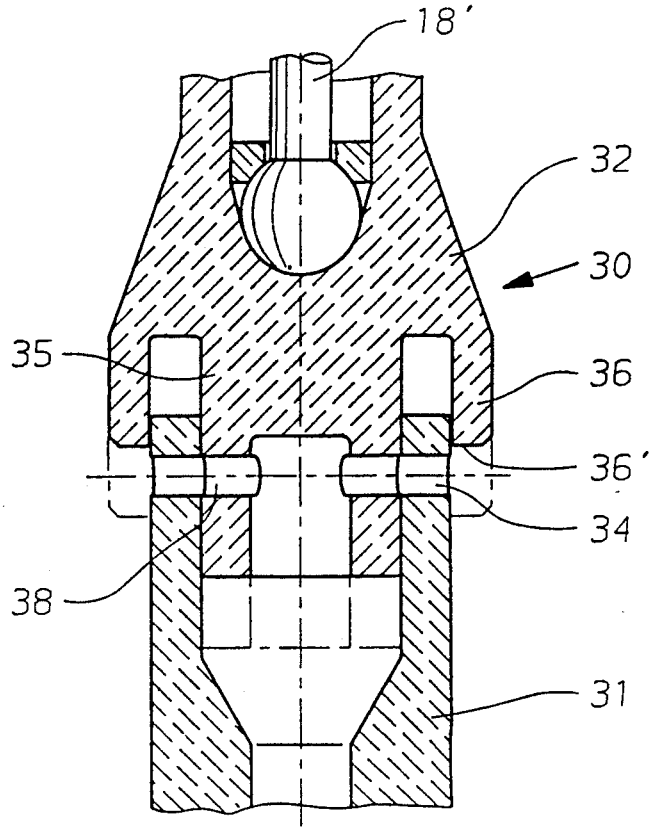

FIG. 5 illustrates a shutoff assembly 30 wherein a rotor 32 is movable with respect to a stator 31 in an axial direction, by means of a rod 18' connected to rotor 32 to enable such motion. Rod 18' can be connected to rotor 32 by a type of ball bearing arrangement to make it possible to compensate for deviations between the axes of the rotor and stator during operation. In this embodiment, the outer tubular section 36 does not have therethrough transverse openings. Rather, outer tubular section 36 includes a lower or free end edge 36' located axially between the opposite end of section 36 and openings 38 in the inner tubular section 35. As a result, when the assembly is in the fully open position illustrated in FIG. 5, free end edge 36' will be located above openings 34 in stator 31. In the closed position of the assembly, illustrated by phantom lines in FIG. 5, stator openings 34 are covered and closed by outer pipe section 36. It additionally is possible in accordance with the present invention to provide the arrangement of FIG. 5 such that rotor 32 is, not only axially movable relative to stator 31, but also rotatably movable relative thereto. This merely would require suitable alteration of the connection between rotor 32 and rod 181.

In the above embodiments of the invention, as somewhat schematically illustrated in FIG. 1, the stator can have depending therefrom an integral, or separate, pouring or casting pipe.

Inner pipe sections 25, 35 of the above embodiments essentially are designed as truncated or shortened integral extensions of rotors 20, 30, a configuration that has a positive effect on strength of the assembly and that enables the length of the rotor to be reduced.

Figure 6:
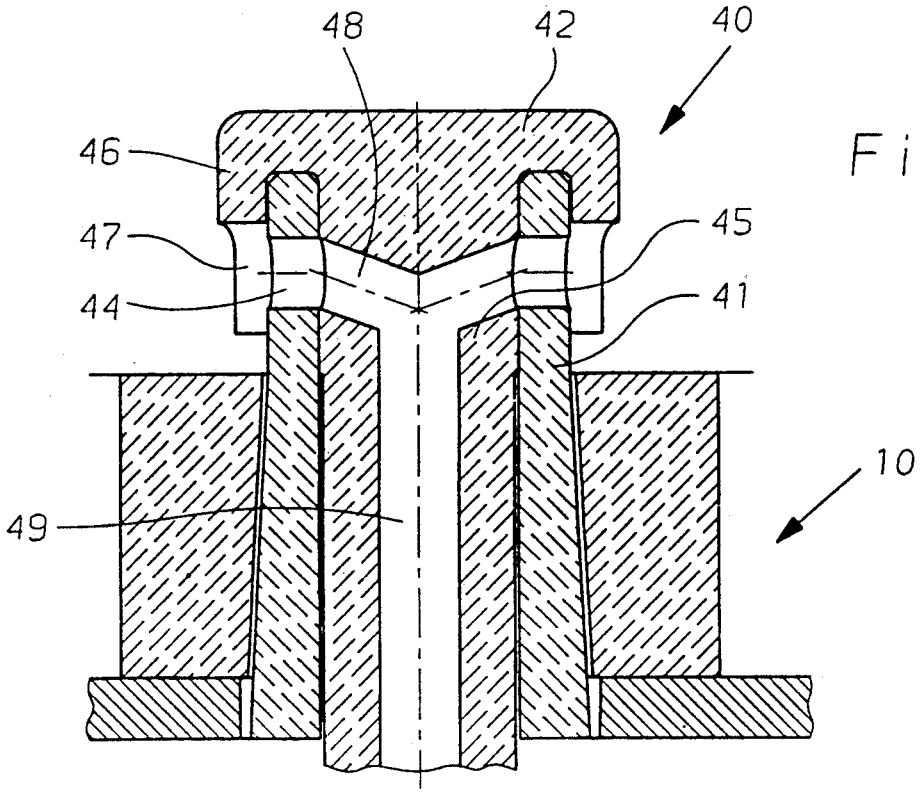
FIG. 6 is an enlarged longitudinal sectional view of a shutoff assembly in accordance with a still further embodiment of the present invention, and specifically wherein the rotor is capable of being driven from below the metallurgical vessel

FIG. 6 shows a further embodiment of a shutoff assembly 40 according to the present invention. In this embodiment, a refractory stator 41 is mounted, for example by mortar, within the nozzle brick of the vessel, and the stator 41 does not extend substantially below or outwardly of the vessel. Rather, a rotor 42 is substantially T-shaped or mushroom-shaped, with an inner tubular section 45 thereof extending downwardly entirely through the stator 41. This enables the rotor to be driven by a drive arrangement provided outwardly of or below the vessel. In this arrangement, the flow of melt discharged from the interior of vessel 10 will be through openings 47 in the outer tubular member 46, openings 44 in stator 41, openings 48 through inner tubular member 45, and then through axial passage 49 extending through inner tubular section 45. In this arrangement also, outer tubular section 46 forms a safety closing function to close the assembly when there no longer is a suitable seal between stator 41 and the inner pipe section 45. More particularly, openings 47 can allow continuation of discharge or can close openings 44 to discontinue discharge.

Although in the above arrangements the invention is illustrated with regard to vertically aligned rotor-stator shutoff assemblies, the present invention also is applicable to such assemblies aligned horizontally to achieve horizontal discharge from a vessel.

Further, although the present invention has been described and illustrated with respect to preferred embodiments thereof, it is to be understood that various changes and modifications to the specifically described and illustrated features may be made without departing from the scope of the present invention.

I claim:

1. A refractory shutoff assembly for controlling the discharge of molten metal from a metallurgical vessel, said assembly comprising:

a refractory tubular stator to be mounted in a wall of a metallurgical vessel, said stator having an axial opening therethrough, inner and outer surfaces, and at least one transverse opening extending between said inner and outer surfaces;

a refractory rotor including inner and outer tubular sections arranged concentrically relative to each other, at least one of said inner and outer tubular sections having therethrough at least one transverse opening;

said rotor being arranged with respect to said stator to be within the interior of the metallurgical vessel and with an outer surface of said inner tubular section sealing with said inner surface of said stator, and with an inner surface of said outer tubular section sealing with said outer surface of said stator; and said rotor being movable relative to said stator between a closed position, whereat said at least one transverse opening in said at least one tubular section of said rotor is isolated from said at least one transverse opening in said stator, and an open position whereat said transverse openings are in alignment.

2. An assembly as claimed in claim 1, wherein said transverse opening in said one of said tubular sections is of the same size as said transverse opening in said stator, and the other said tubular section has therethrough a transverse opening of a greater size.

3. An assembly as claimed in claim 2, wherein said transverse opening in said other tubular section has a size greater than said same sized transverse openings in the direction of movement of said rotor relative to said stator.

4. An assembly as claimed in claim 3, wherein said transverse opening in said other tubular section has a size in said direction at least three times the size of said same sized transverse openings.

5. An assembly as claimed in claim 2, wherein said transverse opening in said other tubular section comprises a recess formed in a free end of said other tubular section.

6. An assembly as claimed in claim 2, wherein said transverse openings in said inner and outer tubular sections are aligned radially and approximately coaxially.

7. An assembly as claimed in claim 2, wherein said one tubular section comprises said inner tubular section, said other tubular section comprises said outer tubular section, and said transverse opening in said outer tubular section is offset with respect to said transverse opening in said inner tubular section, in the direction of movement of said rotor relative to said stator, such that said transverse opening in said outer tubular section is isolated from said transverse opening in said stator before said transverse opening in said inner tubular section is isolated from said transverse opening in said stator.

8. An assembly as claimed in claim 1, wherein said rotor is movable rotatably relative to said stator.

9. An assembly as claimed in claim 8, wherein at least a first said tubular section has an end abutting a stepped surface of said stator.

10. An assembly as claimed in claim 8, wherein said stator has an end abutting a surface of said rotor located between said inner and outer tubular sections.

11. An assembly as claimed in claim 1, wherein said rotor is movable axially relative to said stator.

12. An assembly as claimed in claim 11, wherein said outer tubular section has a free end located at a position axially between said transverse opening in said stator and an opposite end of said outer tubular section when said rotor is in said open position.

13. An assembly as claimed in claim 12, wherein said rotor also is movable rotatably relative to said stator.

14. An assembly as claimed in claim 1, wherein-said rotor is movable both rotatably and axially relative to said stator.

15. An assembly as claimed in claim 1, wherein said inner tubular section has formed in said outer surface thereof an axial groove at a location communicating with said transverse opening in said stator when said rotor is in said closed position, thereby enabling any molten metal in said transverse opening in said stator to be discharged to said axial opening in said stator.

16. An assembly as claimed in claim 1, wherein said inner tubular section extends entirely through said axial opening in said stator and has a lower end capable of being moved from outwardly of the metallurgical vessel.

17. An assembly as claimed in claim 1, further comprising means operatively connected to said rotor for moving said rotor in at least one of rotatably and axially relative to said stator.

18. An assembly as claimed in claim 1, wherein each of said stator and said at least one of said inner and outer tubular sections of said rotor have respective plural transverse openings.

19. An assembly as claimed in claim 18, wherein said plural transverse openings are arranged diametrically.

20. A refractory rotor to be used with a refractory stator to form a shutoff assembly for controlling the discharge of molten metal from a metallurgical vessel, said rotor comprising:

integral inner and outer tubular sections arranged concentrically relative to each other with a space therebetween and having outer and inner surfaces, respectively, to seal with confronting surfaces of a stator to be positioned within said space, at least one of said inner and outer tubular sections having therethrough at least one transverse opening to be brought into and out of alignment with a transverse opening in the stator upon movement of said rotor relative to the stator.

21. A rotor as claimed in claim 20, wherein the other said tubular section has therethrough a transverse opening of a size greater than that of said transverse opening in said one tubular section.

22. A rotor as claimed in claim 21, wherein said transverse opening in said other tubular section has a size greater than that of said transverse opening in said one tubular section in a direction to correspond to a direction of movement of said rotor relative to the stator.

23. A rotor as claimed in claim 22, wherein said transverse opening in said other tubular section has a size in said direction at least three times the size of said transverse opening in said one tubular section.

24. A rotor as claimed in claim 21, wherein said transverse opening in said other tubular section comprises a recess formed in a free end of said other tubular section.

25. A rotor as claimed in claim 21, wherein said transverse openings in said inner and outer tubular sections are aligned radially an approximately coaxially.

26. A rotor as claimed in claim 21, wherein said one tubular section comprises said inner tubular section, said other tubular section comprises said outer tubular section, and said transverse opening in said outer tubular section is offset with respect to said transverse opening in said inner tubular section in a direction to correspond to the direction of movement of said rotor relative to said stator.

27. A rotor as claimed in claim 20, wherein said outer tubular section has a free end located at a position axially between said transverse opening in said inner tubular section and an opposite end of said outer tubular section.

28. A rotor as claimed in claim 20, wherein said inner tubular section has formed in said outer surface thereof an axial groove at a position circumferentially offset from said transverse opening.

29. A rotor as claimed in claim 20, wherein said at least one of said inner and outer tubular sections has therethrough plural transverse openings.

30. A rotor as claimed in claim 29, wherein said plural transverse openings are arranged diametrically.

* * * * *